US005255790A

United States Patent [19]

Einoder et al.

[11] Patent Number: 5,255,790

[45] Date of Patent: Oct. 26, 1993

[54] SCREENING APPARATUS

[75] Inventors: Norbert Einoder, Tegernheim; Waldemar R. Knodel, Pentling, both of Fed. Rep. of Germany

[73] Assignee: Heinrich Fiedler GmbH & Co KG, Regensburg, Fed. Rep. of Germany

[21] Appl. No.: 824,365

[22] Filed: Jan. 23, 1992

[30] Foreign Application Priority Data

Jul. 2, 1991 [DE] Fed. Rep. of Germany ..... 4121897

[51] Int. Cl.[5] ..... B07B 1/49

[52] U.S. Cl. ..... 209/393; 209/395; 210/498

[58] Field of Search ..... 209/268, 273, 393, 395; 210/498, 497.3, 497.01

[56] References Cited

U.S. PATENT DOCUMENTS

| | | | |
|---|---|---|---|
| 703,683 | 7/1902 | Vrooman et al. | 209/395 |
| 4,113,626 | 9/1978 | Detcher | 209/393 X |
| 4,130,479 | 12/1978 | Schiele | 209/395 |
| 4,396,503 | 8/1983 | Schmidt | 209/393 |
| 4,846,971 | 7/1989 | Lamort | 209/273 X |

FOREIGN PATENT DOCUMENTS

| | | | |
|---|---|---|---|
| 316570 | 5/1989 | European Pat. Off. | 209/395 |
| 658759 | 4/1935 | Fed. Rep. of Germany | 209/393 |
| 969759 | 7/1958 | Fed. Rep. of Germany | 209/393 |
| 3327422 | 2/1985 | Fed. Rep. of Germany | 209/393 |
| 631856 | 3/1927 | France | 209/393 |
| 291530 | 6/1928 | United Kingdom | 209/393 |
| 450534 | 7/1936 | United Kingdom | 209/273 |

*Primary Examiner*—D. Glenn Dayoan
*Attorney, Agent, or Firm*—Henry M. Feiereisen

[57] ABSTRACT

A screening apparatus, in particular a bar screen for sorting and classifying fluid flows, especially fiber suspensions includes parallel bar-shaped screen elements mounted on cross bars and defining slotted screening perforations therebetween. At its top surface facing the fluid flow, each screen element is provided with a projection in form of a rib or bead or the like of different cross section to provide an irregular screening surface. The screening slot between neighboring screen elements is defined by at least one wall section which extends parallel to the midplane of the screening slot in order to reduce an expansion of the slot due to wear.

11 Claims, 2 Drawing Sheets

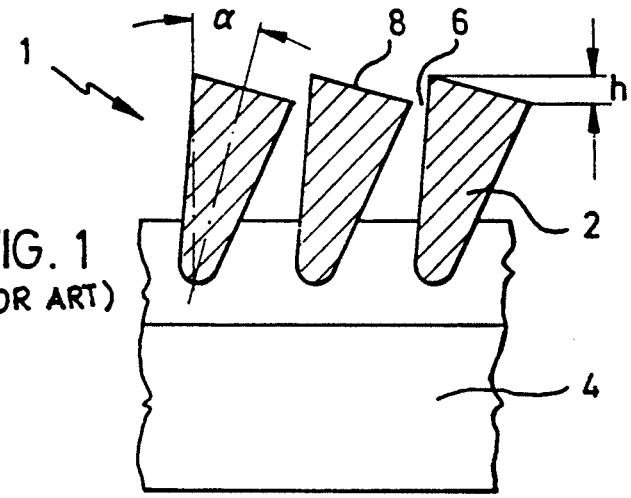
FIG. 1
(PRIOR ART)
FIG. 2
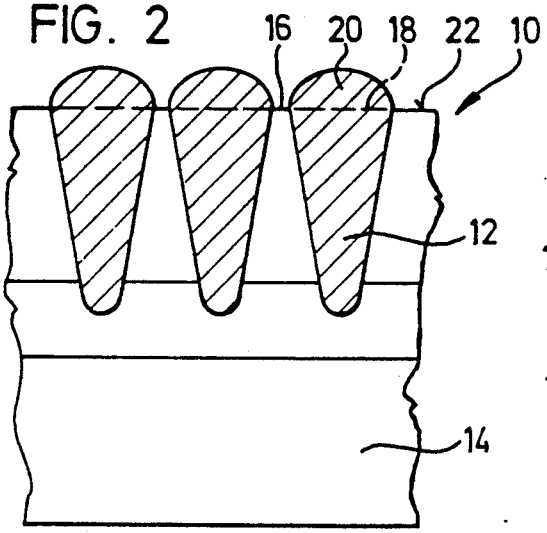
FIG. 3
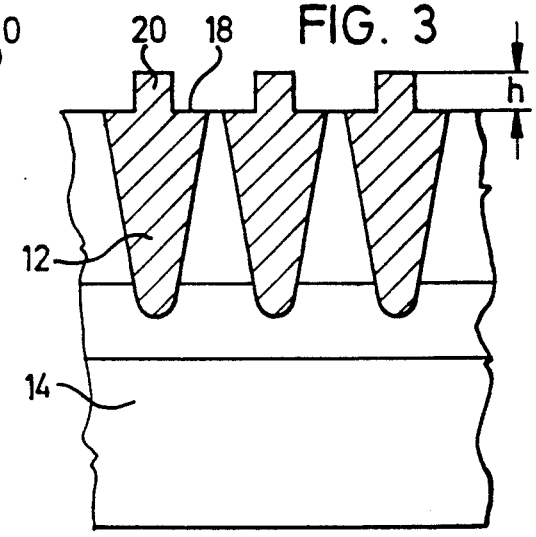
FIG. 4
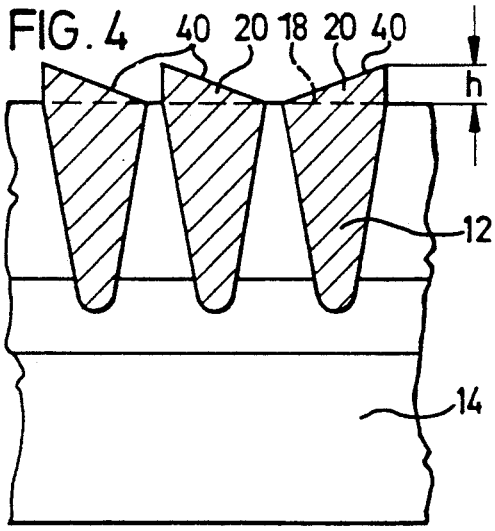
FIG. 5
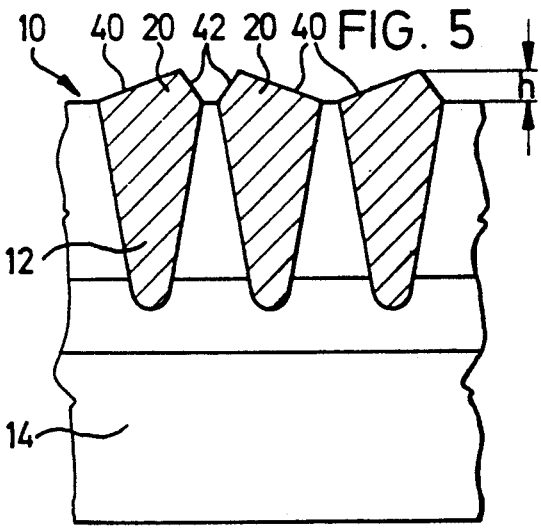

FIG. 6
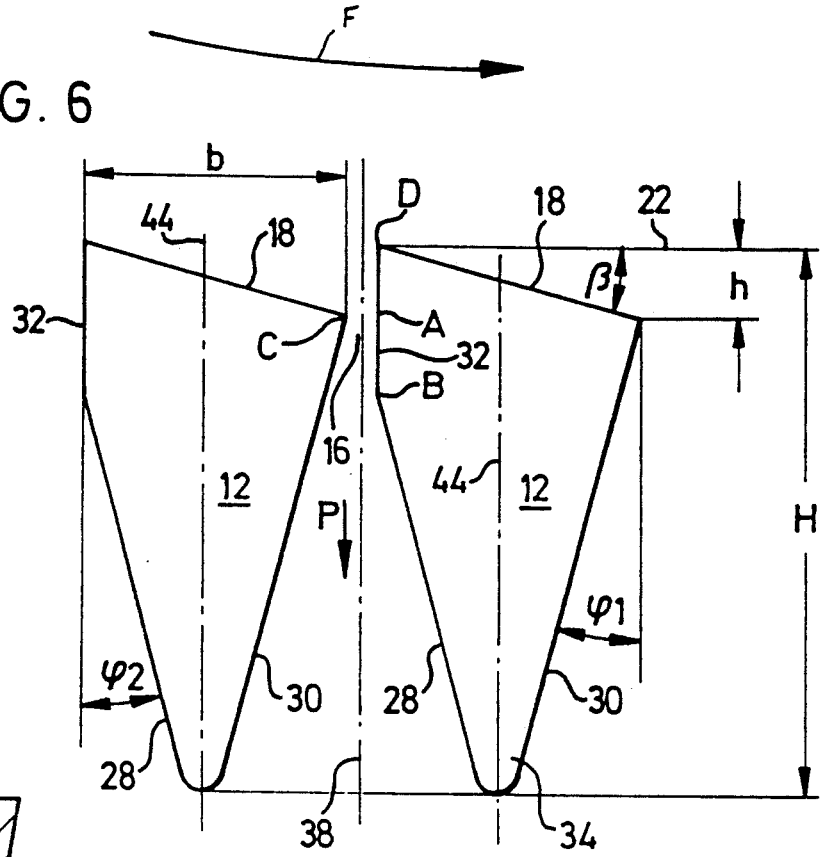
FIG. 8
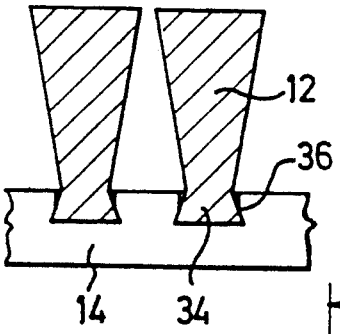
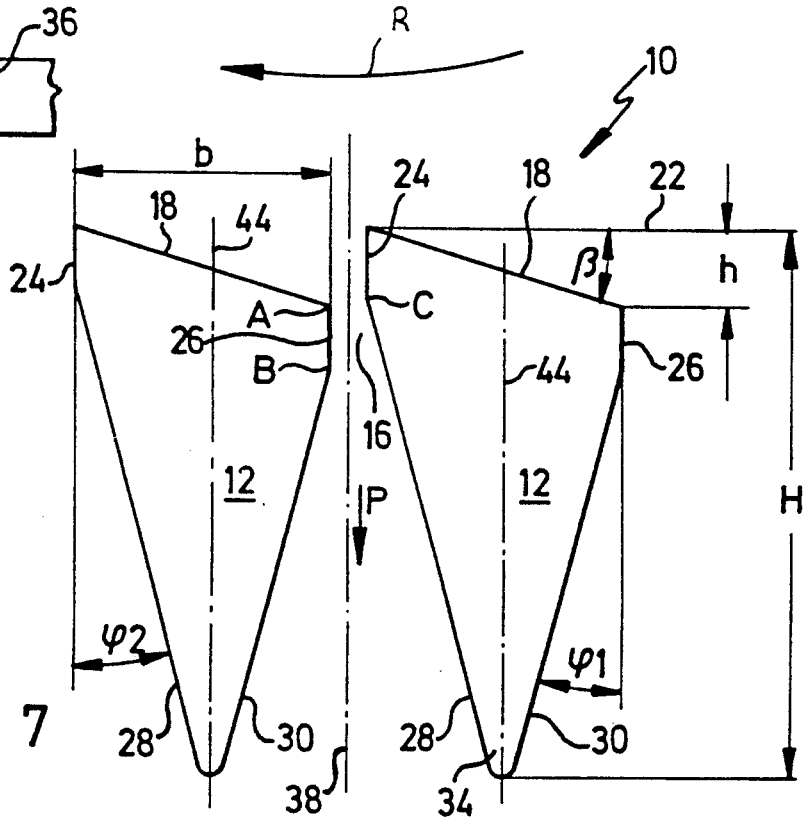
FIG. 7

SCREENING APPARATUS

BACKGROUND OF THE INVENTION

The present invention refers to a screening apparatus for sorting and classifying fluid flows, and in particular to a bar screen, especially for sorting fiber suspensions, and being of the type having a plurality of parallel bar-shaped screen elements mounted on cross bars for forming a screen area and defining slotted screening perforations therebetween which extend essentially transversal to the direction of the fluid flow.

It is known to provide bar screens with triangular screen elements, with their top surface, which faces the incoming fiber suspension, being levelled or flat so as to form a plane screen area. Practice has shown however, that the provision of irregular screening surfaces is advantageous for improving the screening capacity and sorting quality because of the hydrodynamic effect of the screen and the generation of so-called microturbulences. It was thus proposed to slantingly position the screen elements so that their top surface is angled relative to the screen area. In this manner, an approximately stepped screening surface is created.

For manufacturing reasons, the angle of inclination of the screen elements is limited so that the depth of the thus non-levelled screening surface is also limited. Theoretically, the depth could be increased by expanding the width of the screen element, however, such measure would result in a loss of free surface area, thus causing a reduced throughput. Moreover, a slanted arrangement of the screen elements in order to attain an irregular screening area is disadvantageous because it results at the outlet side of the screen in an asymmetric flow space which adversely affects the fluid flow and causes pressure losses.

SUMMARY OF THE INVENTION

It is thus an object of the present invention to provide an improved screening apparatus obviating the aforestated drawbacks.

It is another object of the present invention to provide an improved screening apparatus which includes screen elements of relative great depth without necessitating an inclination of the screen elements.

These objects and others which will become apparent hereinafter are attained in accordance with the present invention by providing the top surface of each screen element with at least one projection which extends in longitudinal direction of the screen element and transversely to the screen area.

The projections may be of any suitable configuration, such as e.g. of rectangular, triangular or serrated cross section, of circular arc shape, nose-like or finger-like configuration, in order to create screen elements with irregular screening surface and without requiring a slanted attachment of the screen elements to the cross bars.

According to another feature of the present invention, at least one wall section of opposing wall sections of two neighboring screen elements, which define the screening slot, extends transversely to the screen area. In this manner, a rapid and undesired expansion of the width of the slot and a deterioration of the sorting quality due to progressing wear of the edges of the screen elements at the inlet side of the screening slot are eliminated or at least greatly diminished.

According to a modification of this embodiment, both opposing wall sections of neighboring screen elements extend transversely to the screen area and at least partly overlap each other so that the screening slot is defined in the overlapping area by two parallel wall sections. This design of the screen elements allows the screening slot to remain constant during wear and tear of the edges at the inlet side into the screening slot, until the overlapping sections of the opposing wall sections are worn off.

BRIEF DESCRIPTION OF THE DRAWING

The above and other objects, features and advantages of the present invention will now be described in more detail with reference to the accompanying drawing in which:

FIG. 1 is a fragmentary schematic partly sectional view of a conventional screening apparatus provided with a plurality of screen elements;

FIGS. 2–5 are fragmentary schematic views of various embodiments of a screening apparatus in accordance with the present invention;

FIGS. 6 and 7 are fragmentary schematic illustrations of two neighboring screen elements, showing in detail the slot area formed between neighboring screen elements; and FIG. 8 is a fragmentary schematic partly sectional view of a screening apparatus illustrating an exemplified attachment of screen elements to respective cross bars.

DETAILED DESCRIPTION OF PREFERRED EMBODIMENTS

Throughout all the Figures, the same or corresponding elements are always indicated by the same reference numerals.

Referring now to the drawing and in particular to FIG. 1, there is shown a fragmentary schematic partly sectional view of a conventional bar screen, generally designated by reference numeral 1 and including a plurality of bar-shaped screen elements 2 which are of essentially triangular cross section and mounted on respective cross bars 4 at an angle a relative to the vertical. By positioning the screen elements 2 at such an inclination, their top surface 8, which faces the fiber suspension to be screened, is thus not levelled so as to improve the screening capacity and the screening quality. For manufacturing reasons, the angle a is limited to a maximum of about 15° so that also the depth h is limited. Even though an increase of the depth h may theoretically be possible by increasing the width of the screen elements 2, such a modification is disadvantageous as it would result in a loss of free surface area and thus would adversely affect the throughput and overall efficiency of the screen. In addition, the inclination of the screen elements 2 causes at the outlet side of the screen elements 2 an asymmetric flow space which leads to pressure losses.

Turning now to FIGS. 2–5, there are shown fragmentary schematic partly sectional views of various embodiments of a screening apparatus in accordance with the present invention, generally designated by reference numeral 10. The screening apparatus 10 includes a plurality of parallel bar-shaped screen elements 12 which are mounted without inclination upon suitable cross bars 14 (only one is shown), with neighboring screen elements 12 defining a screening slot or perforation 16 therebetween. The attachment of the screen elements 12 to the cross bars 14 may be done through welding or through form-fitting connection, as will be described in more detail with reference to FIG. 8.

Each screen element 12 includes a plane or levelled top surface 18 which faces the fiber suspension and is provided with a projection 20 in form of ribs or beads or the like, which extends in longitudinal direction of the screen elements 12, i.e. transversely to the screen area 22. Thus, the screen elements 12 are provided with irregular screening surface, with the depth h being significantly increased, without necessitating an inclination of the screen elements 12 relative to the cross bars 14.

In FIG. 2, the projections 20 are of circular arc shaped configuration and completely cover the top surface 18. In FIG. 3, the projection 20 of the screen elements 12 is formed by a central rib of rectangular cross section while in FIG. 4, the projections 20 are configured in form of a rectangular triangle or in form of a saw tooth and define a slanted surface 40. In FIG. 5, the projections 20 are of triangular cross section, defining a slanted surface 40 and a further slanted surface 42 of sharper inclination. Persons skilled in the art will understand that FIGS. 2-5 show only examples of possible configurations of the projections 20, and other configurations may certainly be conceivable.

In the embodiments according to FIGS. 4 and 5, the screen elements 12 have asymmetric cross section, allowing a versatile arrangement of the screen elements 12. For example, in FIG. 4, the left and central screen elements are mounted to the cross bar 14 with the slanted surface 40 ascending toward the left while the slanted surface 40 of the right screen element 12 ascends toward the right. In FIG. 5, the installation of the screen elements 12 is such that the slanted surface 40 of the left and right screen elements 12 ascends toward the right while the slanted surface 40 of the central screen element 12 ascends toward the left. Thus, when providing the screen elements with asymmetric configuration, as shown in the non-limiting examples of FIGS. 4 and 5, the effective screen area can be selectively designed by differently positioning neighboring screen elements 12 i.e. through turning the screen elements 12 by 180° about the longitudinal axis of the screen element.

Referring now to FIG. 6, there is shown a fragmentary schematic illustration of two neighboring screen elements 12, showing in detail the area of the screening slot 16 between neighboring screen elements 12 for sorting and classifying a fluid flow e.g. a fiber suspension incoming and flowing in direction of arrow F. Each screen element 12 is provided with a slanted top surface 18 which extends at an angle $\beta$ to the screen area 22, with the center axis 44 of the screen element 12 being oriented at an angle of 90° to the screen area 22. Thus, the screen elements 22 are mounted to the respective cross bars (not shown) without inclination.

Each screen element 12 has one side face which includes a plane vertical wall section 32 extending parallel to the midplane 44 and downwards from the top surface 18 over a certain length and is connected to an inwardly slanted wall section 28 which describes an angle $\phi_2$ with a vertical (i.e. with the prolongation of the wall section 32). At its lower end, the wall section 28 is connected to a side face 30 which extends at an angle $\phi_1$ to the vertical and leads to the top surface 18.

The screening slot 16 is defined between the wall section 32 of one screen element 12 (in FIG. 6, the right screen element) and the upper wall section of side face 30 of a neighboring screen element 12 (in FIG. 6, the left screen element). Defined at the junction of side face 30 and top surface 18 of the left screen element 12 is an upstream edge C which bounds the inlet to slot 16 and extends above a downstream edge B defined at the junction of the wall section 28 and wall section 32 of the right screen element 12. In opposition to corner point C of the left screen element 12 is point A of the right screen element 12, which point A is spaced by a distance h from the screen area 22.

During operation and progressing wear of upstream edge C, the slot 16 expands only at the side of the left screen element 12 because upstream edge C is opposed by a straight or flat wall section 32 which extends transversely to the screen area 22, and thus parallels the midplane 38 of slot 16. Only, when wear of the left screen element has progressed beyond the downstream edge B, i.e. downwards in FIG. 6 will the slot 16 expand at both sides.

By providing the wall section 32 parallel to the midplane 38 and in opposition of the upstream edge C of the neighboring screen element, the expansion or enlargement of the slot 16 can be kept within narrow limits during progressing wear.

Referring now to FIG. 7, there is shown a modification of the screening apparatus for sorting and classifying a fluid flow e.g. a fiber suspension flowing in direction of arrow R, with screen elements 12 being provided with parallel and straight wall sections 24, 26 which extend over a certain length from each end of the top surface 18 in direction toward the cross bars (not shown) and are respectively connected to the converging side faces 28 and 30 which define an angle $\phi_1$ and $\phi_2$ with a vertical upon the screen area 22 and thus with the midplanes 44 and midplane 38. Like in the embodiment of FIG. 6, the top surface 18 is slanted and extends at an angle $\beta$ relative to the screen area 22, without inclination of the screen elements 12 so that their midplanes 44 are normal to the screen area 22.

Both wall sections 24, 26 extend transversely to the screen area 22 and thus parallel the midplanes 44 of the screen elements 12 and the midplane 38 of the screening slot 16 as formed between neighboring screen elements 12. As shown in FIG. 7, the slot 16 is defined between successive screen elements 12 by the wall sections 26 and 30 of one screen element 12 (left screen element in FIG. 7) and by the wall sections 24 and 28 of the neighboring screen element 12 (right screen element in FIG. 7).

As shown in FIG. 7, the opposing wall sections 26 and 24 slightly overlap each other in direction of the fluid flow through that screening slot as indicated by arrow P, with the right screen element 12 defining a downstream edge C at the junction of the wall section 24 with the wall section 28, and with the left screen element 12 defining a upstream edge A at the junction of the top surface 18 with the wall section 26, whereby the upstream edge A is arranged slightly ahead of the downstream edge C. The distance between the upstream edge A and downstream edge C may be in the range of a few tenth of millimeters to about 1 millimeter, preferably between 0.2 to 0.8 mm, with a distance of 0.5 mm being particularly preferred in flow direction P.

When the upstream edge A starts to wear off, the width of the slot 16 remains constant until the upstream edge A is opposite the downstream edge C. Upon further wear, the overlap of wall sections 26 and 24 is eliminated, and the corner point A shifts below the downstream edge C. Even though, the slot 16 now expands, the expansion is slow and occurs only at the side of the right screen element 12 in correspondence with the inclination of wall section 28 because downstream edge C is opposed by the straight or flat wall section 26 which extends transversely to the screen area 22 and thus parallel to the midplane 38 of slot 16. Only, when wear of the left screen element has progressed beyond the downstream edge B will the slot 16 expand at both sides in accordance with the inclination of wall sections 28 and 30.

Suitably, the height of wall section 26 may be in the range of 0.2–0.8 mm or greater while the height of wall section 24 may be equal or greater than height h.

The parallel arrangement of wall section 26 which represents a wear surface essentially eliminates a rapid expansion of the screening slot through wear.

In the exemplified embodiments of FIGS. 6 and 7, the angle $\beta$ about 10°–30°, preferably about 15°, the width of the slot 16 is about 0.05 to about 1 mm, the angles $\beta_1$ and $\phi_2$ are about 10°–20°, preferably about 15°, the width of each bar-shaped screen element 12 is about 1.5–4 mm and the height of each screen element 12 is about 2.5–7 mm. The height h can be determined by the width b of the screen element 12 and the angle $\beta$.

Turning now to FIG. 8, there is shown a fragmentary partly sectional view of a screening apparatus illustrating an exemplified attachment of the screen elements 12 to respective cross bars 14. FIG. 8 illustrates an example of a form-fitting attachment, with each screen element 12 including a profiled base 34, e.g. of dovetail cross section, which engages a complementary indentation 36 in the cross bars 14. Persons skilled in the art will understand that the screen elements may also be attached to the cross bars by other suitable means.

While the invention has been illustrated and described as embodied in a screening apparatus, it is not intended to be limited to the details shown since various modifications and structural changes may be made without departing in any way from the spirit of the present invention.

What is claimed as new and desired to be protected by Letters Patent is set forth in the appended claims:

We claim:

1. Screening apparatus for sorting and classifying a fluid flow; comprising a plurality of screen elements mounted on cross bars and defining a screen area, each of said screen elements having a top surface, a first side face including a plane wall section which extends from one end of said top surface transversely to the screen area, and a second side face including a plane wall section which extends from the other end of said top surface transversely to the screen area, wherein the plane wall section of said first side face of on screen element extends parallel to the plane wall section of said second side face of a successive screen element to define a screening slot therebetween through which fluid flows, with each of the plane wall sections of said first and second side faces defining a downstream edge, with the downstream edge of the plane wall section of said first side face of one screen element being provided in flow direction of the fluid through said screening slot ahead of the downstream edge of the opposing plane wall section of said second side face of said successive screen element.

2. The screening apparatus defined in claim 1 wherein said top face of said screen elements extends at an acute angle relative to a vertical upon the screen area.

3. The screening element defined in claim 1 wherein said top surface is inclined relative to the screen area by an angle of about 10°–30°.

4. The screening element defined in claim 3 wherein said top surface is inclined relative to the screen area by an angle of about 15°.

5. The screening apparatus as defined in claim 1 wherein the plane wall section of said first side face of one screen element at least partly overlaps the plane wall section of said second side face of the successive screen element by about 0.2–0.8 mm.

6. The screening apparatus as defined in claim 5 wherein the plane wall section of said first side face of one screen element and the plane wall section of said second side face of the successive screen element overlap each other by about 0.5 mm.

7. The screening apparatus defined in claim 1 wherein said first side face further includes an inwardly slanted wall section which connects to said plane wall section at the outlet edge and describes an acute angle with a vertical upon the screen area, and wherein said second side face further includes an inwardly slanted wall section which is connected to said wall section of said second side face at the outlet edge and describes an acute angle with a vertical upon the screen area.

8. The screening apparatus defined in claim 7 wherein said inwardly slanted wall sections of said first and second side faces describe an acute angle of about 10°–20° with the vertical upon the screen area.

9. The screening apparatus defined in claim 7 wherein said inwardly slanted wall section of said first side face describes an acute angle of about 20° with the vertical upon the screen area.

10. The screening apparatus defined in claim 7 wherein said inwardly slanted wall section of said second side face describes an acute angle of about 15° with the vertical upon the screen area.

11. The screening apparatus defined in claim 5 wherein the outlet edge of said first side face of one screen element and the outlet edge of the second side faces of a successive screen element are spaced from each other in direction of the fluid flow at a distance which is about 1.0–1.5 times the overlap of the plane wall sections of said first and second side faces of successive screen elements.

* * * * *